US010403462B2

(12) United States Patent
Allcorn et al.

(10) Patent No.: US 10,403,462 B2
(45) Date of Patent: Sep. 3, 2019

(54) FUSE ASSEMBLY

(71) Applicant: Delphi Technologies, LLC, Troy, MI (US)

(72) Inventors: James Randall Allcorn, Frankfort, MI (US); Donald Gary Smith, Flint, MI (US); William J. Mosby, Redford, MI (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/951,501

(22) Filed: Apr. 12, 2018

(65) Prior Publication Data

US 2018/0301310 A1 Oct. 18, 2018

Related U.S. Application Data

(60) Provisional application No. 62/486,646, filed on Apr. 18, 2017.

(51) Int. Cl.
*H01H 85/20* (2006.01)
*H01H 85/06* (2006.01)
(Continued)

(52) U.S. Cl.
CPC ..... *H01H 85/205* (2013.01); *H01H 85/044* (2013.01); *H01H 85/06* (2013.01);
(Continued)

(58) Field of Classification Search
CPC .... H01H 85/205; H01H 85/143; H01H 85/06; H01H 2085/2055; H01H 71/20;
(Continued)

(56) References Cited

U.S. PATENT DOCUMENTS

| | | | | |
|---|---|---|---|---|
| 8,130,070 | B2 * | 3/2012 | Shibata | H01H 85/044 29/623 |
| 8,669,840 | B2 | 3/2014 | Urrea et al. | |
| 2002/0064999 | A1 | 5/2002 | Kobayashi et al. | |
| 2004/0137792 | A1 | 7/2004 | Matsumura et al. | |
| 2007/0241857 | A1 * | 10/2007 | Ito | H01H 85/045 337/187 |
| 2008/0030295 | A1 | 2/2008 | Matsumoto et al. | |

(Continued)

OTHER PUBLICATIONS

ZCASE Masterfuse Data Sheet, Littelfuse, Inc., retrieved from Internet address: http://www.littelfuse.com/products/fuses/automotive-passenger-car/high-current-fuses/zcase-masterfuse.aspx on Mar. 22, 2018.

*Primary Examiner* — Anatoly Vortman
*Assistant Examiner* — Stephen S Sul
(74) *Attorney, Agent, or Firm* — Robert J. Myers

(57) ABSTRACT

A fuse assembly includes an insulating block having an upper surface, a lower surface, and a side surface therebetween. The insulating block defines cavities extending therethrough. Each cavity defines a resilient lock arm. A fuse assembly also includes a first terminal stud secured within a first cavity by a first lock arm, a second terminal stud secured within a second cavity by a second lock arm, and a bus bar disposed parallel to the bottom surface of the insulating block. The bus bar is interconnected to the first terminal stud by a lower terminal connected to the bus bar and an upper terminal disposed parallel to the upper surface. The bus bar is interconnected to the second terminal stud by a fusible link having a lower fuse terminal connected to the bus bar and an upper fuse terminal disposed generally parallel to the upper surface.

18 Claims, 7 Drawing Sheets

(51) Int. Cl.
*H01H 85/143* (2006.01)
*H01H 85/044* (2006.01)
*H01H 85/055* (2006.01)

(52) U.S. Cl.
CPC ..... *H01H 85/143* (2013.01); *H01H 85/20* (2013.01); *H01H 2085/0555* (2013.01); *H01H 2085/2055* (2013.01)

(58) Field of Classification Search
CPC ..... H01H 21/165; H01H 85/22; H01H 85/50; H01H 85/62; H01H 2085/0034; H01H 2085/2075; H01H 85/185
USPC ..... 361/150, 168, 191, 227
See application file for complete search history.

(56) References Cited

U.S. PATENT DOCUMENTS

| | | | | |
|---|---|---|---|---|
| 2009/0108982 | A1 | 4/2009 | Ohashi et al. | |
| 2010/0051311 | A1* | 3/2010 | Nakagawa | H01R 11/287 174/59 |
| 2011/0100706 | A1* | 5/2011 | Matsui | H05K 7/026 174/541 |
| 2011/0285496 | A1 | 11/2011 | Urrea et al. | |
| 2013/0120101 | A1* | 5/2013 | Taguchi | H01H 85/20 337/190 |
| 2014/0045351 | A1* | 2/2014 | Yamamoto | H01R 9/226 439/76.2 |
| 2014/0097932 | A1* | 4/2014 | Fussl | H01H 85/044 337/191 |
| 2017/0358418 | A1* | 12/2017 | Carnick | H01H 85/0241 |

* cited by examiner

FUSE ASSEMBLY

CROSS-REFERENCE TO RELATED APPLICATION

This application claims the benefit under 35 USC § 119(e) of U.S. Provisional Patent Application No. 62/486,646 filed on Apr. 18, 2017, the entire disclosure of which is hereby incorporated by reference.

TECHNICAL FIELD OF THE INVENTION

The invention generally relates to circuit protection devices and more particularly to a fuse assembly having easily replaceable circuit attaching studs.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A fuse assembly is presented herein. The fuse assembly includes treaded studs that are held in place by flexible locking arms, allowing easy assembly of the fuse assembly and removal and replacement of the treaded studs if the treaded studs are damaged.

FIGS. 1 through 8 illustrate a non-limiting example of a fuse assembly 10. The illustrated example of the fuse assembly is configured to be incorporated into a motor vehicle such as an automobile, light truck, or commercial vehicle. Other embodiments may be adapted to different uses, such as industrial equipment, or aerospace applications.

Figure 1:
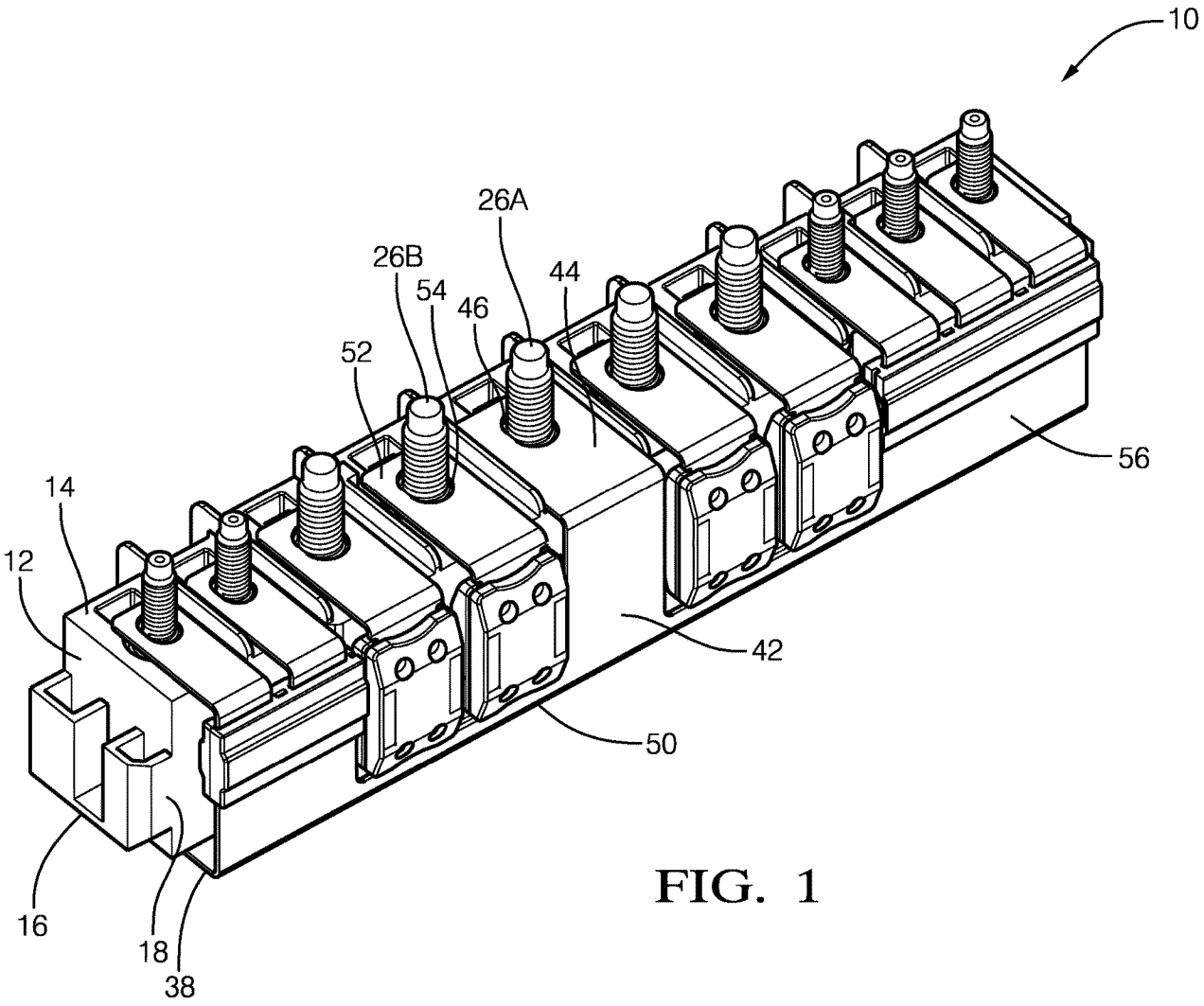
FIG. 1 is a perspective view of a fuse assembly in accordance with an embodiment of the invention.
Figure 2:
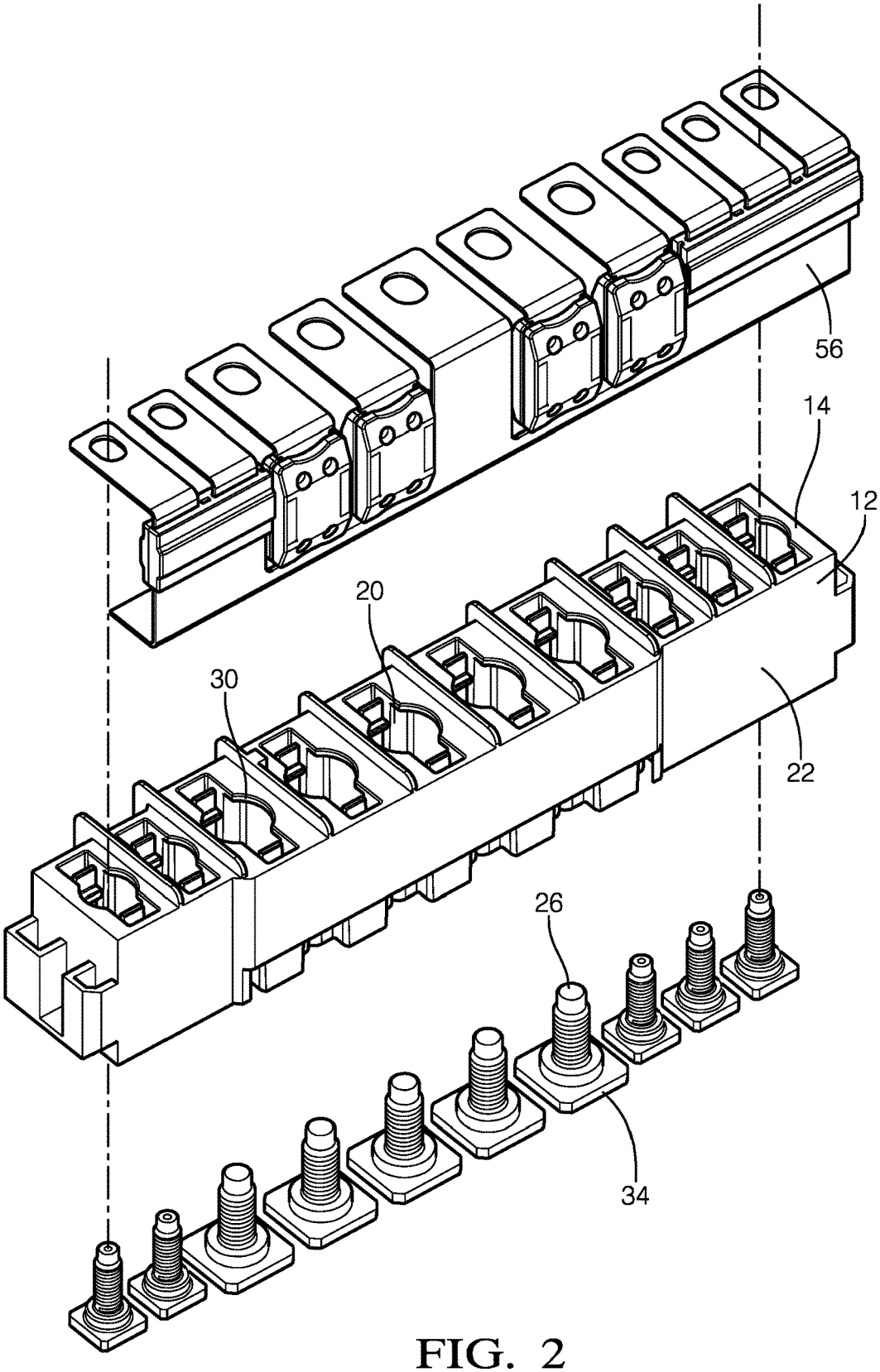
FIG. 2 is an exploded perspective view of the fuse assembly of FIG. 1 in accordance with an embodiment of the invention.
Figure 3:
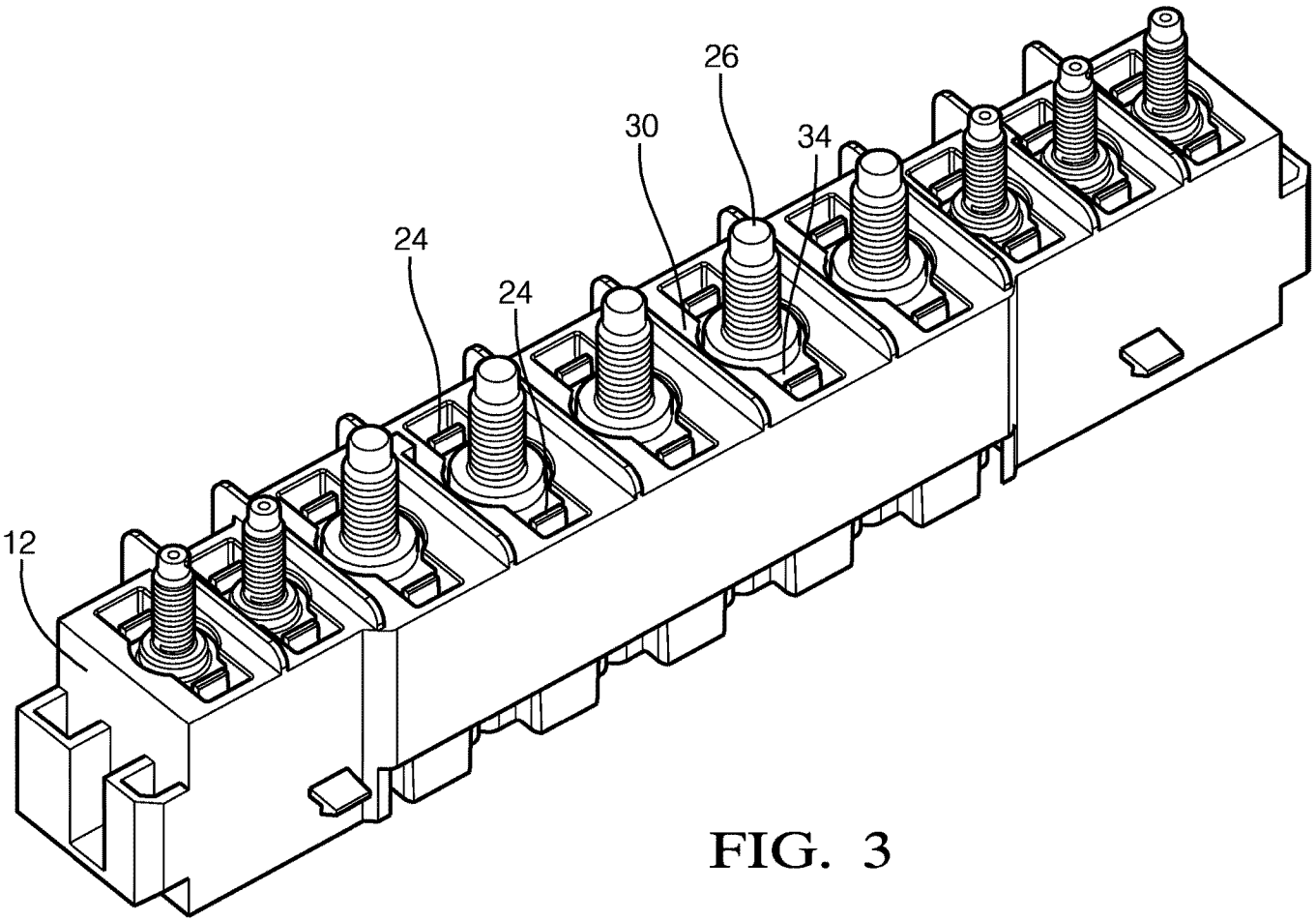
FIG. 3 is a perspective view of the an insulator block and terminals of the fuse assembly of FIG. 1 in accordance with an embodiment of the invention.
Figure 7B:
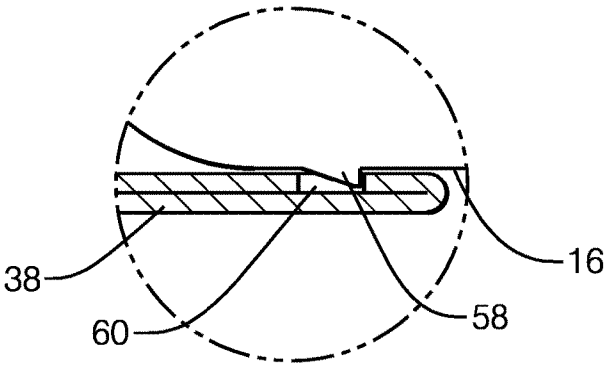
FIG. 7B is a close up view of a bus bar retention feature of the fuse assembly of FIG. 1 in accordance with an embodiment of the invention.
Figure 7A:
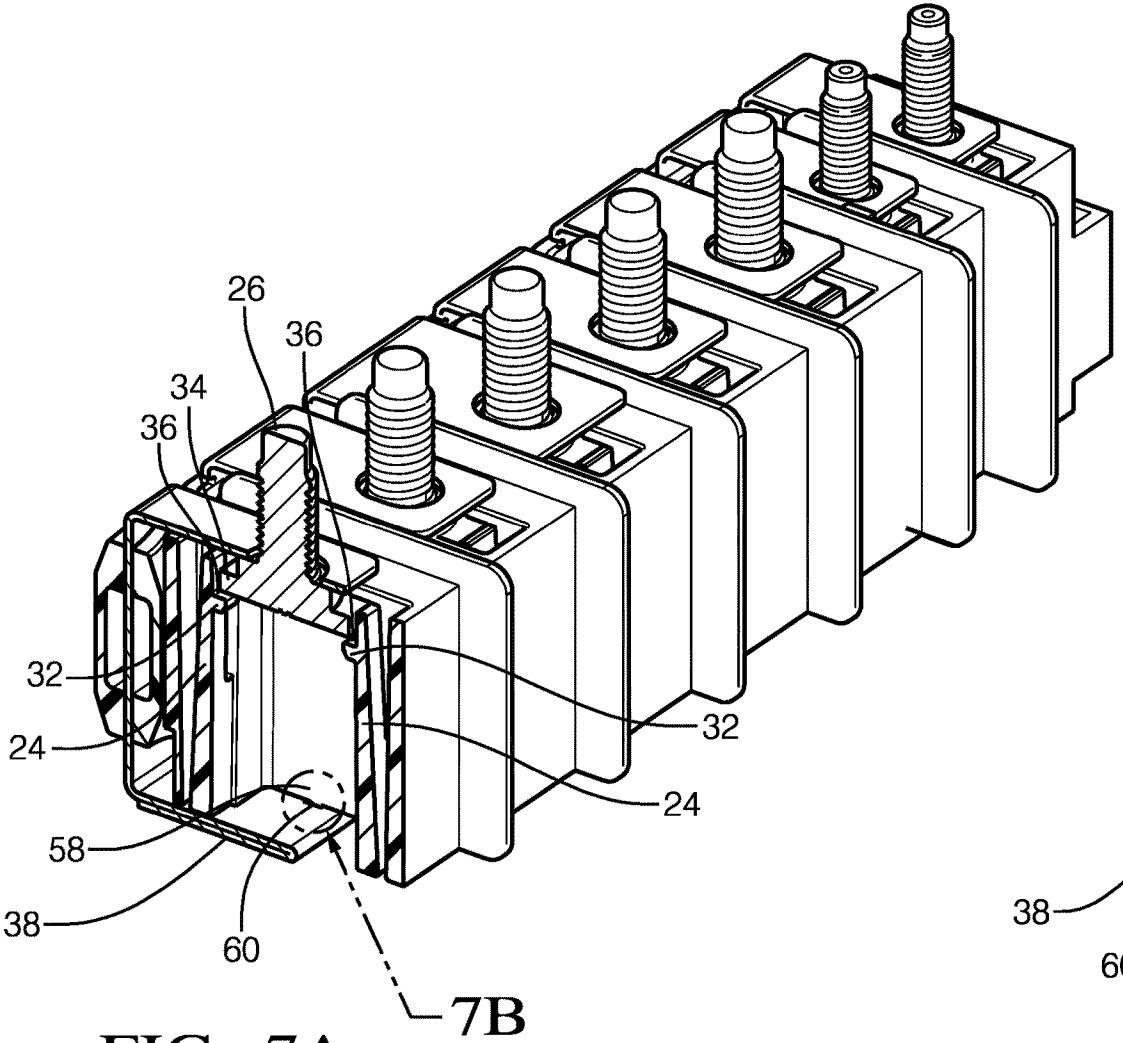
FIG. 7A is a perspective cross section view of the fuse assembly of FIG. 1 in accordance with an embodiment of the invention.
Figure 8:
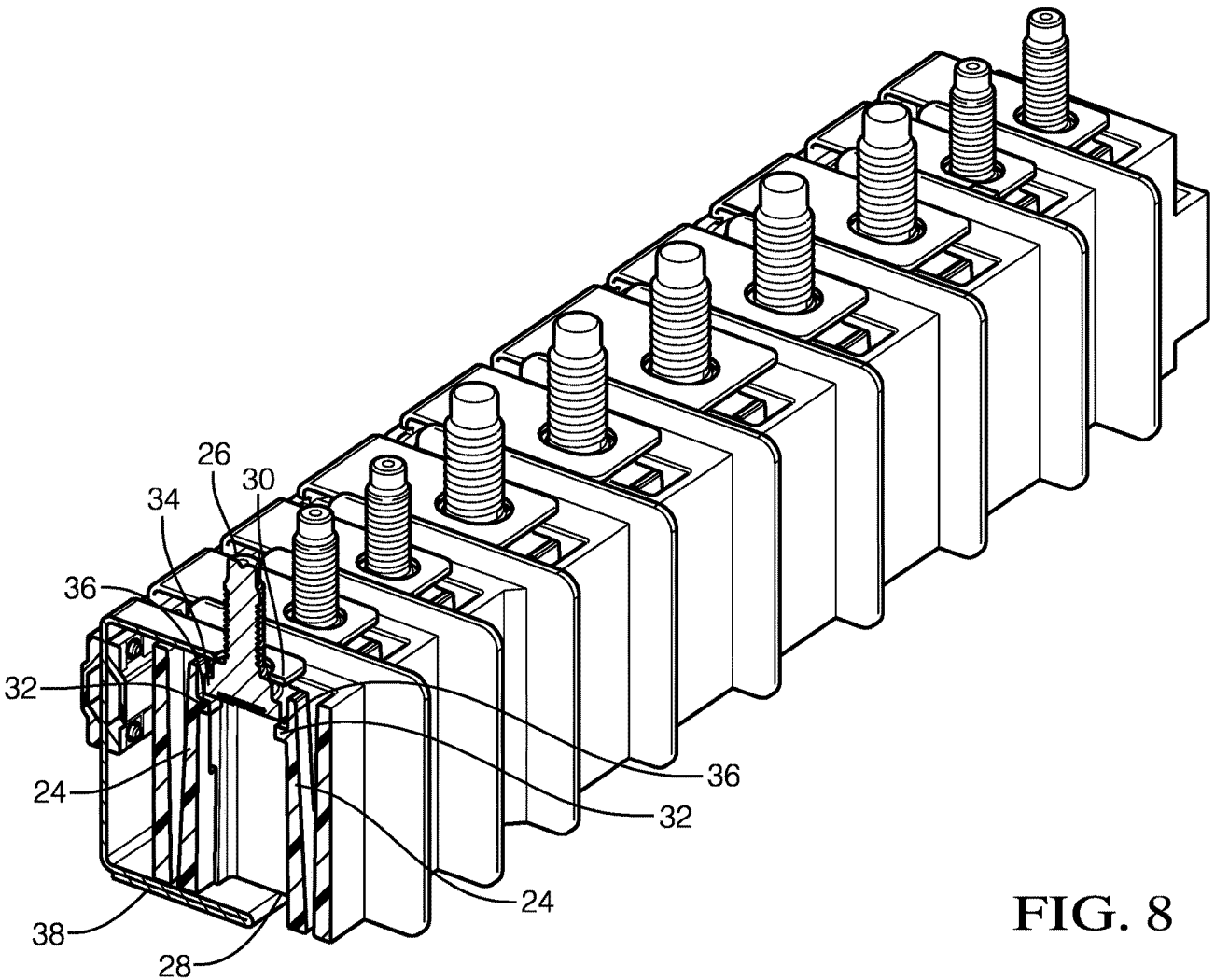
FIG. 8 is another perspective cross section view of the fuse assembly of FIG. 1 in accordance with an embodiment of the invention.

As illustrated in FIG. 1, the fuse assembly 10 includes an insulating block 12 having an upper surface 14, a lower surface 16, and a side surface 18 therebetween. The insulating block 12 defines a number of cavities 20 extending from the lower surface 16 to the upper surface 14, wherein an inner side wall 22 of each cavity 20 of the insulating block 12 defines a resilient lock arm 24. Threaded terminal studs 26 are inserted into some or all of these cavities 20 by inserting the studs 26 in a lower cavity opening 28 in the lower surface 16 and extending the studs 26 through an upper cavity opening 30 in the upper surface 14. As best shown in FIGS. 7 and 8, the side walls 22 of each of the cavities 20 define resilient lock arms 24 in the form of inwardly angled cantilevered beams that include triangular shaped lock tabs 32 near the free ends of the lock arms 24. The studs 26 include a planar base plate 34 that is oriented generally perpendicular to the stud 26. As the stud 26 is inserted into the cavity 20, the base plate 34 contacts the lock tabs 32, urging the lock arms 24 toward the side wall 22 of the cavity 20 until the base plate 34 clears the lock tab 32 at which point the lock arms 24 spring inwardly and a locking surface 36 of the lock tab 32, which is generally parallel to the upper surface 14 of the insulating block 12, engages the base plate 34 and inhibits removal of the stud 26 through the lower cavity opening 28. The upper cavity opening 30 in the upper surface 14 is smaller than the base plate 34, so the base plate 34 is retained in the cavity 20 by being trapped between the upper surface 14 and the lock tabs 32. The stud 26 may be removed from the cavity 20 for replacement if it is damaged by inserting a tool (not shown) within the lower cavity opening 28 to compress the lock arms 24 toward the side walls 22, thereby releasing the lock tabs 32 from engagement with the base plate 34.

The insulating block 12 is formed from a dielectric material, preferably a polymer such as polybutylene terephthalate (PBT) or polyamide (PA, NYLON). The stud 26 is formed of an electrically conducting material, such as a copper alloy.

As illustrated in FIG. 1, the fuse assembly 10 also includes a bus bar 38 that is disposed generally parallel to the lower surface 16 of the insulating block 12. The bus bar 38 is interconnected to a first terminal stud 26A by an integral conductor 40 having a lower terminal 42 connected to the bus bar 38 and an upper terminal 44 disposed generally parallel to the upper surface 14. The upper terminal 44 defines a first oval shaped aperture 46 that is configured to receive the first terminal stud 26A, thereby electrically connecting the first terminal stud 26A directly to the bus bar 38. The first terminal stud 26A is connected to the electrical power source (not shown), typically a battery in a motor vehicle. The bus bar 38 is also interconnected to a second terminal stud 26B by an integral fusible link 48 having a lower fuse terminal 50 connected to the bus bar 38 and an upper fuse terminal 52 disposed generally parallel to the upper surface 14 (see FIG. 4B). The upper fuse terminal 52 defines a second oval shaped aperture 54 that is configured to receive the second terminal stud 26B, thereby electrically connecting the second terminal stud 26B to the bus bar 38 through the fusible link 48. The second terminal stud 26B is connected to a protected circuit. As shown in FIG. 1, this arrangement with fusible links of various current capacities is repeated with additional treaded terminals providing overcurrent protection for a number of protected circuits.

Figure 4A:
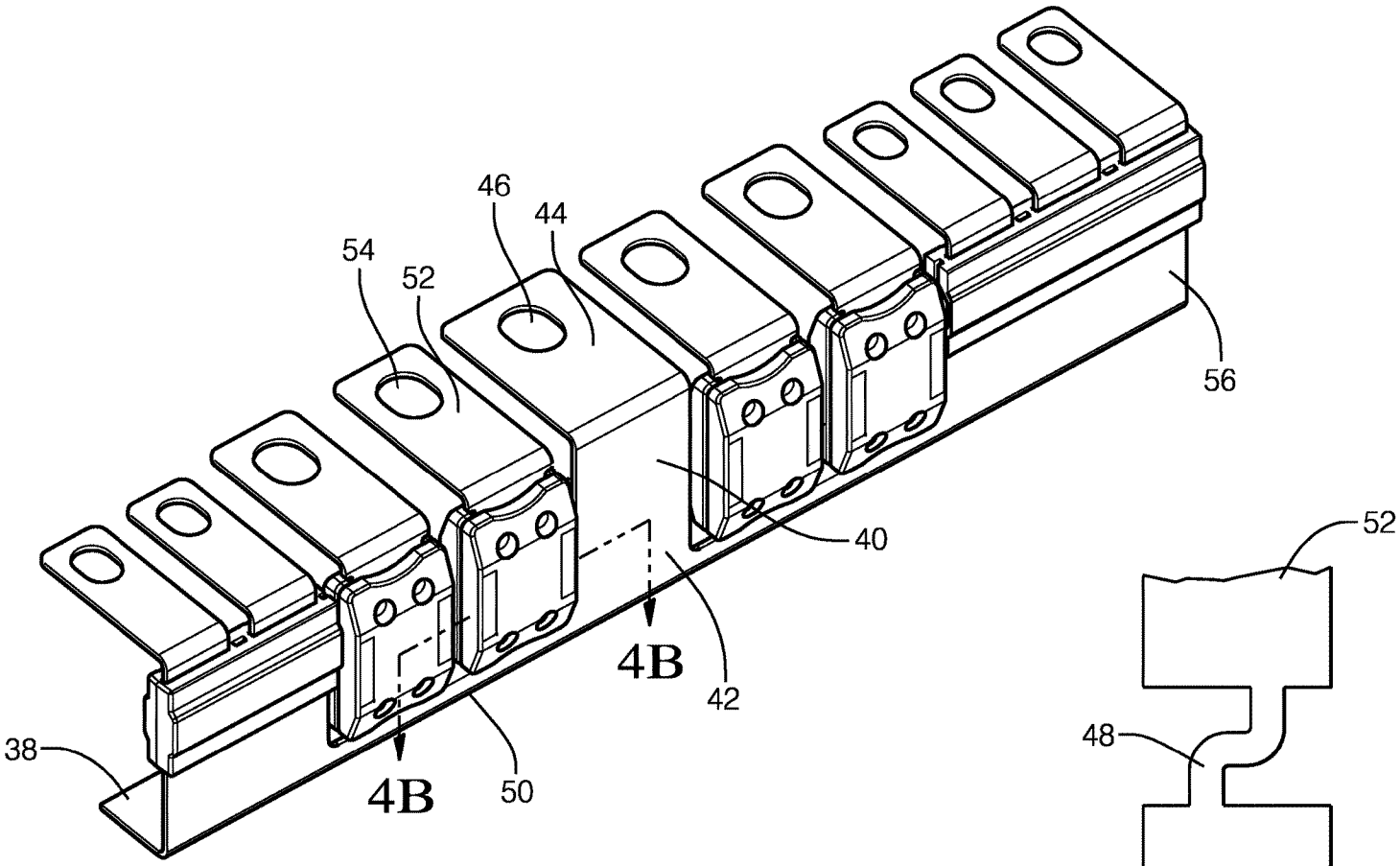
FIG. 4A is a perspective view of a bus bar of the fuse assembly of FIG. 1 in accordance with an embodiment of the invention.
Figure 4B:
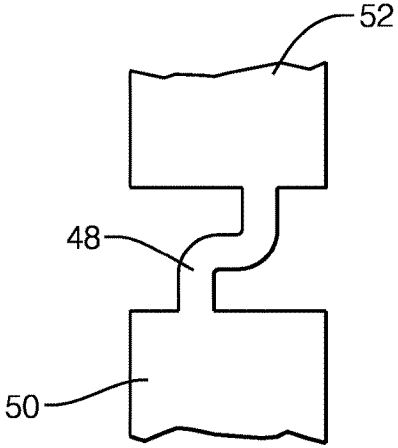
FIG. 4B is a cutout view of the bus bar of FIG. 4A showing a fusible link in accordance with an embodiment of the invention.
Figure 5:
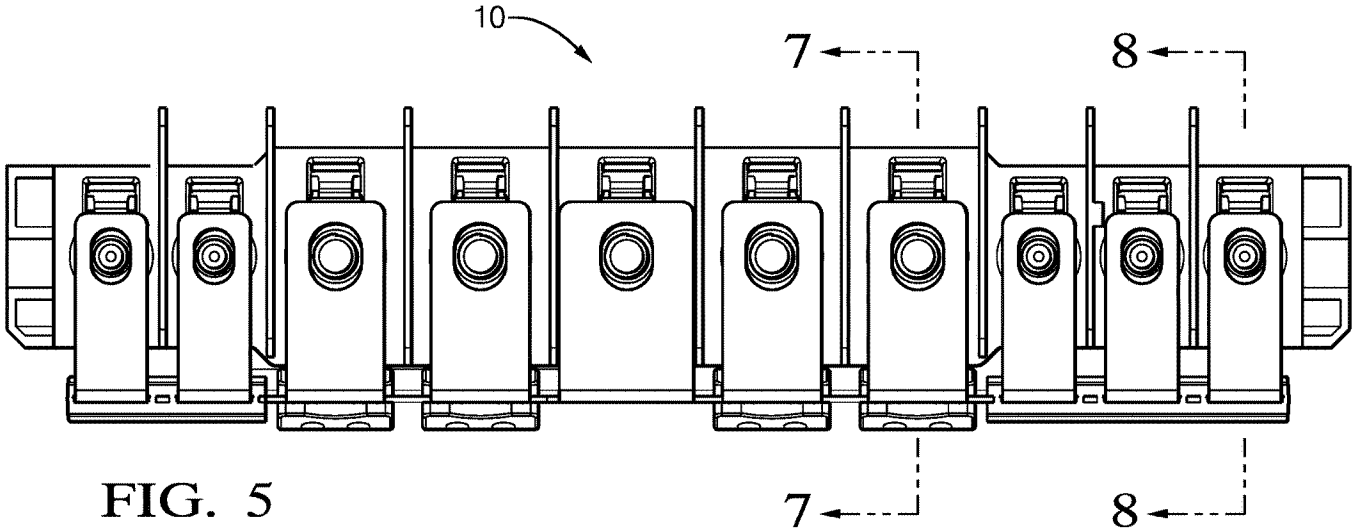
FIG. 5 is a top view of the fuse assembly of FIG. 1 in accordance with an embodiment of the invention.
Figure 6:
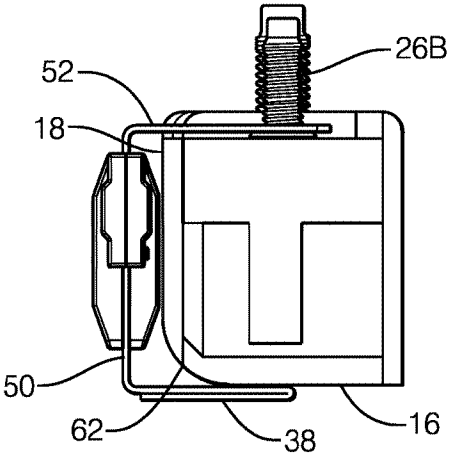
FIG. 6 is a side view of the fuse assembly of FIG. 1 in accordance with an embodiment of the invention.

The bus bar 38, upper terminal 44, conductor 40, upper fuse terminal 52 and fusible link 48 form a fuse card 56 that, as best shown in FIG. 4A, is characterized as having a C shape. The fuse card 56 is secured to the insulating block 12 by the insertion of the studs 26A, 26B in the apertures 46, 54 of the upper terminal 44 and upper fuse terminal 52 and a triangular lower locking tab 58 on the lower surface 16 of the insulating block 12 that is captured within a rectangular window 60 in the bus bar 38. The fuse card 56 is attached to the insulating block 12 by first inserting the studs 26A, 26B in the apertures 46, 54 of the upper terminal 44 and upper fuse terminal 52. The fuse card 56 flexes as the bus bar 38 then slides over the rounded corner 62 between the side surface 18 and the lower surface 16 of the insulating block 12 and across the lower surface 16 until the lower locking tab 58 is received within the window 60 in the bus bar 38. The fuse card 56 may be removed to gain access to the lock arms 24 retaining the studs 26 or to replace an open fusible link 48 by prying the bus bar 38 away from the lower locking tab 58 and sliding the fuse card 56 over the rounded edge of the insulating block 12.

The fusible link 48 is encapsulated within a polymeric insulator in order to protect surrounding materials in case of a fusible link 48 opening and to provide additional structural rigidity to the fusible link 48.

While the illustrated example shows a threaded stud 26 with a generally square base plate 34, alternative embodiments may be envisioned having different stud types and different base plate shapes.

Additionally, while the illustrated example of FIGS. 1-8 shows the bus bar 38 disposed generally parallel to the lower surface 16 of the insulating block 12, alternative embodiments of the fuse assembly 10 may be envisioned in which the bus bar is disposed generally parallel to the side surface 18 of the insulating block 12, thereby providing an L shaped fuse card 56. In this embodiment, the side surface 18 defines the lower locking tab 58 that secures the fuse card 56 to the insulator block by engaging the window 60 in the bus bar 38.

Accordingly, a fuse assembly 10 is provided. The fuse assembly 10 allows replacement of a damaged stud 26 or open fusible link 48 without the need to replace the entire fuse assembly 10. This compact design of the fuse assembly 10 also allows the fuse assembly 10 to be passed through front of dash (FOD) openings with the wiring harness for easier to assemble and more cost effective wiring harness designs. The insulating block 12 holds the studs 26 securely for torqueing fasteners to the studs 26 without requiring a full bracket.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

We claim:

1. A fuse assembly, comprising:

an insulating block having an upper surface, a lower surface, and a side surface therebetween, said insulating block defining a first cavity extending therethrough from the lower surface to the upper surface, wherein inner side walls of the first cavity define a first pair of resilient lock arms, said insulating block further defining a second cavity extending therethrough from the lower surface to the upper surface, wherein inner side walls of the second cavity define a second pair of resilient lock arms;

a first terminal stud protruding from the upper surface and secured within the first cavity by the first pair of lock arms;

a second terminal stud protruding from the upper surface and secured within the second cavity by the second pair of lock arms; and a bus bar disposed generally parallel to the lower surface of the insulating block, wherein the bus bar is interconnected to the first terminal stud by an integral conductor having a lower terminal connected to the bus bar and an upper terminal disposed generally parallel to the upper surface, said upper terminal defining a first aperture in which the first terminal stud is received and wherein the bus bar is interconnected to the second terminal stud by an integral fusible link having a lower fuse terminal connected to the bus bar and an upper fuse terminal disposed generally parallel to the upper surface, said upper fuse terminal defining a second aperture in which the second terminal stud is received.

2. The fuse assembly in accordance with claim 1, wherein the bus bar is secured to the insulating block by a locking tab defined by the lower surface that is received within an aperture defined by the bus bar.

3. The fuse assembly in accordance with claim 2, wherein a junction of the side surface and the lower surface is rounded.

4. The fuse assembly in accordance with claim 3, wherein the fusible link is disposed generally parallel to the side wall.

5. The fuse assembly in accordance with claim 3, wherein the fusible link is encapsulated within a polymeric insulative material.

6. The fuse assembly in accordance with claim 1, wherein the first terminal stud defines a generally planar base plate oriented generally perpendicular to the first terminal stud and wherein the first pair of lock arms secures the base plate within the first cavity.

7. The fuse assembly in accordance with claim 1, wherein the first pair of lock arms is in the form of a pair of cantilevered beams.

8. The fuse assembly in accordance with claim 7, wherein the pair of cantilevered beams are angled inwardly at an angle less than 45 degrees.

9. The fuse assembly in accordance with claim 8, wherein the cantilevered beams of the first pair of lock arms define triangular shaped lock tabs near free ends of the first pair of lock arms.

10. The fuse assembly in accordance with claim 9, wherein the lock tabs define locking surfaces generally parallel to the upper surface of the insulating block, said locking surfaces engage the base plate and inhibit removal of the first terminal stud from the first cavity.

11. The fuse assembly in accordance with claim 10, wherein the first aperture is smaller than the base plate and wherein the base plate is disposed between the upper surface and the lock tabs.

12. The fuse assembly in accordance with claim 1, wherein the second pair of lock arms is in the form of a pair of cantilevered beams.

13. The fuse assembly in accordance with claim 12, wherein the pair of cantilevered beams are angled inwardly at an angle less than 45 degrees.

14. The fuse assembly in accordance with claim 13, wherein the second terminal stud defines a generally planar base plate oriented generally perpendicular to the second terminal stud and wherein the second pair of lock arms secures the base plate within the second cavity.

15. The fuse assembly in accordance with claim 14, wherein the cantilevered beams of the second pair of lock arms define a triangular shaped lock tabs near free ends of the second pair of lock arms.

16. The fuse assembly in accordance with claim 15, wherein the lock tabs define locking surfaces generally parallel to the upper surface of the insulating block, said locking surfaces engage the base plate and inhibit removal of the second terminal stud from the second cavity.

17. The fuse assembly in accordance with claim 16, wherein the second aperture is smaller than the base plate and wherein the base plate is disposed between the upper surface and the lock tabs.

18. A method of manufacturing a fuse assembly, comprising the step of:

forming an insulating block having an upper surface, a lower surface, and a side surface therebetween, said insulating block defining a first cavity extending therethrough from the lower surface to the upper surface, wherein inner side walls of the first cavity define a first pair of resilient lock arms, said insulating block further defining a second cavity extending therethrough from the lower surface to the upper surface, wherein inner side walls of the second cavity define a second pair of resilient lock arms;

forming a first terminal stud protruding from the upper surface and secured within the first cavity by the first pair of lock arms;

forming a second terminal stud protruding from the upper surface and secured within the second cavity by the second pair of lock arms; and forming a bus bar disposed generally parallel to the lower surface of the insulating block, wherein the bus bar is interconnected to the first terminal stud by an integral conductor having a lower terminal connected to the bus bar and an upper terminal disposed generally parallel to the upper surface, said upper terminal defining a first aperture in which the first terminal stud is received and wherein the bus bar is interconnected to the second terminal stud by an integral fusible link having a lower fuse terminal connected to the bus bar and an upper fuse terminal disposed generally parallel to the upper surface, said upper fuse terminal defining a second aperture in which the second terminal stud is received.

* * * * *